US005607101A

United States Patent [19]

Saito

[11] Patent Number: 5,607,101

[45] Date of Patent: Mar. 4, 1997

[54] POSTAL MATTER

[76] Inventor: Toshiki Saito, c/o Toshiki Saito Design Room 1-13-25, Nishishinsaibashi, Chuo-ku, Osaka-shi, Osaka 542, Japan

[21] Appl. No.: 406,282

[22] Filed: Mar. 17, 1995

[30] Foreign Application Priority Data

| | | | |
|---|---|---|---|
| Mar. 23, 1994 | [JP] | Japan | 6-002539 U |
| Sep. 7, 1994 | [JP] | Japan | 6-011145 U |
| Nov. 16, 1994 | [JP] | Japan | 6-282182 |

[51] Int. Cl.[6] ..... B65D 27/04

[52] U.S. Cl. ..... 229/71; 229/72; 229/92.8; 206/462

[58] Field of Search ..... 229/71, 72, 92.8; 206/776, 777, 778, 779, 462, 467

[56] References Cited

U.S. PATENT DOCUMENTS

| | | | |
|---|---|---|---|
| 3,194,482 | 7/1965 | Berkley | 229/71 |
| 3,278,015 | 10/1966 | Bernstein | 229/71 X |
| 4,840,275 | 6/1989 | Faiola et al. | 206/462 X |
| 4,870,764 | 10/1989 | Boone | 229/92.8 X |
| 4,951,404 | 8/1990 | Lithwick | 206/462 X |
| 5,119,952 | 6/1992 | Warriner, Jr. | 206/462 |

FOREIGN PATENT DOCUMENTS

| | | | |
|---|---|---|---|
| 2422559 | 12/1979 | France | 229/71 |
| 63-52750 | 4/1988 | Japan . | |
| 64-42252 | 3/1989 | Japan . | |
| 64-47636 | 3/1989 | Japan . | |
| 1-214486 | 8/1989 | Japan . | |
| 3-100473 | 10/1991 | Japan . | |
| 4-45289 | 4/1992 | Japan . | |
| 4-52432 | 5/1992 | Japan . | |
| 4-124674 | 11/1992 | Japan . | |
| 5-39106 | 10/1993 | Japan . | |

*Primary Examiner*—Jes F. Pascua
*Attorney, Agent, or Firm*—Jordan and Hamburg

[57] ABSTRACT

The invention relates to postal matter having an obverse and a reverse of which the obverse is provided with a portion allotted for affixing a postage stamp thereto etc. and another portion allotted for indicating an address. The postal matter in the form of this post card can be assembled and includes a sheet and a housing portion which can be secured to the reverse of the sheet and can accommodate a small article. The postal matter in the form of a sealed letter can be assembled and includes an envelope having a flap adapted to close an opening of the envelope and a housing portion which can be secured either to the back of the envelope or to the flap and can accommodate a small article. This inventive postal matter draws a recipient's attention, because the small article is accommodated in such a manner as to project from the surface so that one glance may be enough to make a recipient aware that something is inside of the housing portion.

18 Claims, 6 Drawing Sheets reverse
obverse
1
3
17
18
h
A
A
4
12
11
2
13
14
12
11
2 c
4
16
12
17
11

3
23
22
4
b
15
16
12
a
2
17
11

SECTION A-A

SECTION D - D

POSTAL MATTER

BACKGROUND OF THE INVENTION

The present invention relates to postal matter adapted to have an address written thereon as is the case with an ordinary post card or an ordinary sealed letter. The postal matter in accordance with the present invention may have a postage stamp or stamps put thereon or, alternatively, may be mailed on terms of separate payment of postage instead of an affixed postage stamp. In particular the invention concerns itself with postal matter which can be mailed with various kinds of a small article attached thereto in such a manner as to be made prominent and conspicuous.

In recent years, direct mail in the form of a post card or a sealed letter is in general use as an advertising medium.

The obverse of a post card for use in direct mail has a portion allotted either for affixing a postage stamp thereto or for affixing a postmark indicating that the post card is mailed on terms of separate payment of postage instead of an affixed postage stamp. The obverse of a post card for use in direct mail has another portion allotted for writing an address thereon. A photograph and/or an ad-copy is printed on the reverse thereof. There is no teaching in the prior art that a small article such as a sample can be sent together with a post card for use in direct mail.

A sealed letter for use in direct mail includes an envelope having a flap adapted to close an opening of the envelope. The front of this envelope has a portion allotted either for affixing a postage stamp thereto or for affixing a postmark indicating that the sealed letter is mailed on terms of separate payment of postage instead of an affixed postage stamp. The front of this envelope has another portion allotted for writing an address thereon. A space for accommodating letter paper, etc. is defined by the front and the back of this envelope. The envelope is sealed and mailed when a sheet or sheets of letter paper carrying an ad-copy, together with a small article such as a sample, have been put therein. Since the envelope is made of opaque material, one cannot look therethrough to see what is inside thereof. This holds good even for a window envelope, in which case one can merely take a look at an address through the window.

On the other hand, it is most common to accommodate a commodity in a transparent housing and secure the housing to a rigid sheet, which has a hole or a hook-shaped member at the top so as to allow the rigid sheet to be suspended vertically. On many occasions, features of the commodity are printed on the front of the rigid sheet, while instructions to be followed by users are printed on the back thereof. However, this assembly consisting of a commodity, transparent housing and rigid sheet cannot be sent by itself as postal matter. In order to send this assembly as postal matter, it must be put in an envelope.

Nowadays, the number of families who lay aside direct mail without reading it or even without unsealing it is increasing. The effectiveness of advertising cannot be hoped for if the number of families who read or unseal direct mail decreases. Those who send out direct mail are well aware of this fact, and yet they send out direct mail simply because it can be economically mailed as long as it has a prescribed size, thickness and weight.

In view of the above-described problems, one of the primary objects of the invention is to provide postal matter in the form of a post card which takes a recipient by surprise because the post card is accompanied by a small article.

Another object of the invention is to provide postal matter for use in the form of a sealed letter which also takes a recipient by surprise because a small article is attached to the sealed letter in such a manner as to be made prominent and conspicuous.

SUMMARY OF THE INVENTION

According to one aspect of the present invention, there is provided postal matter in the form of a post card which can be assembled and which includes a sheet having an obverse and a reverse, the obverse being provided with a portion allotted either for affixing a postage stamp thereto or for affixing a postmark indicating that the post card is mailed on terms of separate payment of postage instead of an affixed postage stamp and another portion allotted for indicating an address. The postal matter in the form of this post card further includes a housing portion which can be secured to the reverse of the sheet and can accommodate a small article. The postal matter in the form of this post card is ready for being mailed when a small article has been accommodated in the housing portion and when the housing portion has been secured to the reverse of the sheet. The postal matter in the form of this post card draws a recipient's attention, because the small article is accommodated in such a manner as to project from the surface of the sheet so that one glance may be enough to make a recipient aware that something is inside of the housing portion. The mailing of postal matter in the form of this post card can be rendered relatively inexpensive in cost if the sheet has a prescribed size and if the overall thickness of the sheet and the housing portion falls within a prescribed limit. If the housing portion is made of a transparent substance, a small article accommodated therein will immediately attract a recipient's attention. A post card of simplified costruction for ease and economy of manufacture will be provided if the housing portion is adapted to be secured to the post card by means of a flange and if this flange is adapted to be clamped between a first sheet and a second sheet of which the post card consists.

According to another aspect of the invention, there is provided postal matter for use in the form of a sealed letter which can be assembled and which includes an envelope having a flap adapted to close an opening of the envelope. The front of this envelope has a portion allotted either for affixing a postage stamp thereto or for affixing a postmark indicating that the sealed letter is mailed on terms of separate payment of postage instead of an affixed postage stamp. The front of this envelope has another portion allotted for writing an address thereon. A space for accommodating letter paper, etc. is defined by the front and the back of this envelope. The postal matter in the form of this sealed letter further includes a housing portion which can be secured either to the back of the envelope or to the flap and can accommodate a small article. The postal matter for use in the form of this sealed letter is ready for being mailed when letter paper, etc. have been accommodated in the envelope, when a small article has been accommodated in the housing portion, and when the housing portion has been secured either to the back of the envelope or to the flap. The mailing of postal matter for use in the form of this sealed letter can be rendered relatively inexpensive in cost if the envelope has a prescribed size and if the overall thickness of the envelope with its contents and the housing portion falls within a prescribed limit. If the housing portion is made of a transparent substance, a small article accommodated therein will immediately attract a recipient's attention. Simplified construction for ease and economy of manufacture will be provided if an envelope having a flap is formed from a blank in which two creases are created in a desired dimensionally spaced relationship in such a manner that side portions located at opposite sides of the middle portion are folded so as to be in juxtaposition to the middle portion and if the housing portion is adapted to be secured either to the back of the envelope or to the flap.

Figure 1C:
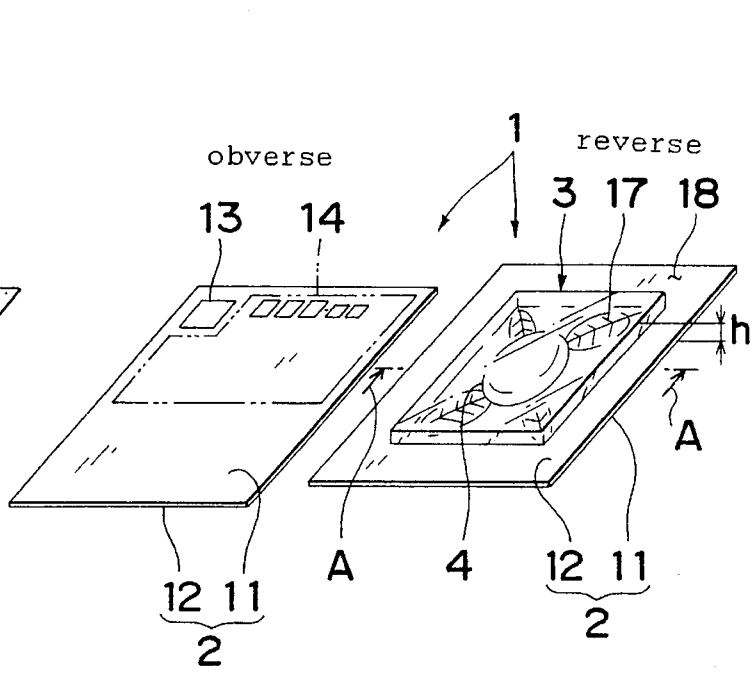
FIGS. 1(*a*)–(*c*) are perspective views of an embodiment of the present invention in the form of a post card.
Figure 1B:
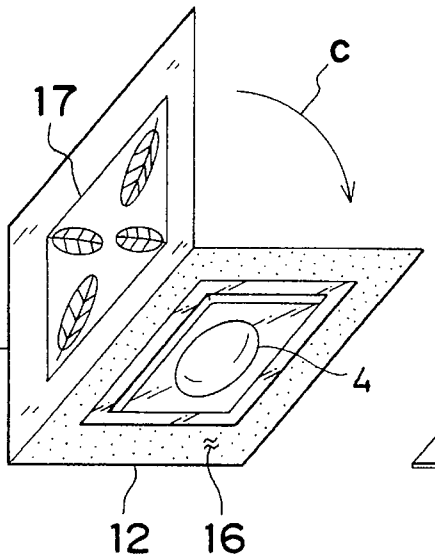
Figure 1A:
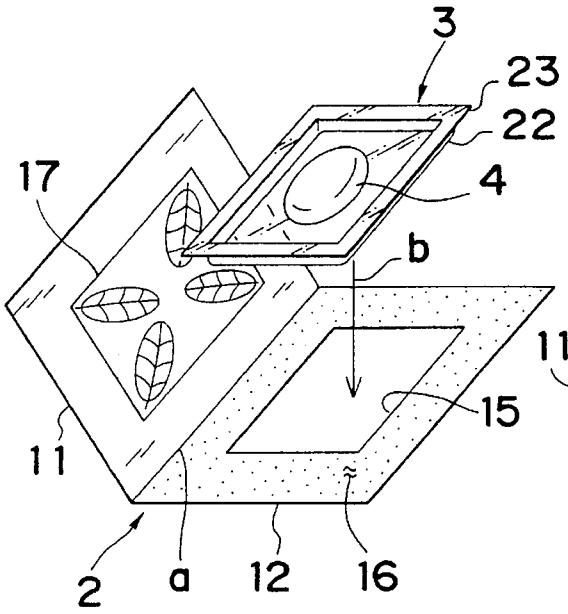

DETAILED DESCRIPTION OF THE PREFERRED EMBODIMENTS:

The invention may best be understood by reference to the following description taken in connection with the accompanying drawings. FIG. 1 shows a preferred embodiment of the present invention in the form of a post card. FIGS. 1(*a*) and 1(*b*) show the procedures for assembling the same, while FIG. 1(*c*) shows a finished post card ready for being mailed.

For those who wish to accommodate a small article of their own choosing, this post card may be sold as a kit which consists of a sheet and a housing portion in a knocked-down condition. Alternatively, this post card may be sold in an assembled condition with a small article already accommodated in the housing portion. In the latter case, the post card is ready for being mailed. The purchaser has only to write an address and put a postage stamp thereon. It is contemplated that this post card will be found especially effective when distributed for the purpose of promoting the sale of a small article.

Reference will first be specifically made to the post card in an assembled condition. Postal matter in the form of a post card 1 in an assembled condition shown in FIG. 1(*c*) comprises a sheet 2, housing portion 3 and small article 4. The sheet 2 shown in FIG. 1(*a*) is made of paper or the like and is folded along a center line a by which the sheet 2 is divided into a first half 11 and a second half 12. Both halves 11 and 12 are of post card size.

When the sheet 2 has been folded along the center line a, one of the two surfaces of the first half 11 constitutes the obverse of the post card 1. As shown in FIG. 1(*c*), the obverse of the post card 1 has a portion 13 allotted for affixing a postage stamp and another portion 14 allotted either for writing an address or for applying a label on which an address is printed. The size of an area enclosed with a border printed on the portion 13 corresponds to the size of the postage stamp to be affixed. The amount of the postage for the post card 1 may also be printed in the border. A large number of post cards 1 can be mailed on terms of separate payment of postage instead of affixing a postage stamp to each of them. In this case, a postmark indicating that the post card 1 is mailed on terms of separate payment of postage is affixed to the portion 13. In the portion 14, no entries are made except an address and a conventional expression (such as "Confidential" or "Urgent") which it is customary to enter in this portion. According to the Japanese postal regulations by way of example, the portion 14 should measure 8 cm long by 4.5 cm broad at least.

The second half 12 shown in FIG. 1(*a*) has an opening 15 in the center thereof in the shape of a window. When the sheet 2 is folded along the center line a, the first half 11 comes to be disposed in overlying relationship with respect to the second half 12. In this condition, one of the two surfaces of the second half 12 constitutes an inner surface, to the whole of which an adhesive 16 is applied.

Figure 2:
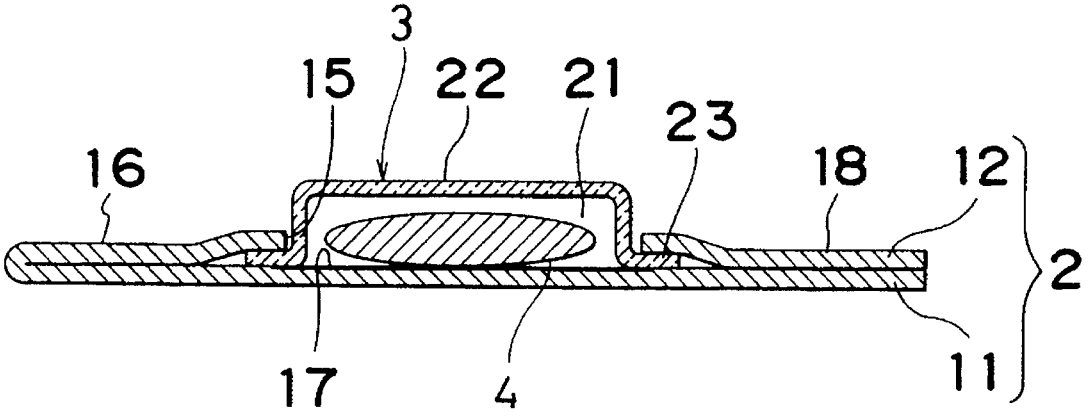
FIG. 2 is a sectional view corresponding to the line A—A of FIG. 1.

As shown in FIG. 2, the housing portion 3 comprises a central cup section 22 and a flange 23. The central cup section 22 has a cavity 21 and is allowed to fit into the opening 15 as indicated by an arrow b in FIG. 1(*a*) to the extent of projecting outwardly of the opening 15. Then the flange 23 is secured to the second half 12 by means of the adhesive 16 as shown in FIG. 1(*b*). The housing portion 3 is made by subjecting rigid transparent plastic such as polypropylene, styrol, polyethylene terephthalate or biodegradable polylactide to a forming process. If a small article 4 to be accommodated in the cavity 21 is brittle, it is desirable to make the housing portion 3 rigid enough to be free from deformation even if the postal matter is handled roughly by post-office clerks. Preferably the whole or main part of the housing portion 3 is made transparent or semitransparent so that one glance may be enough to make a recipient aware what is accommodated in the cavity 21. Especially, when the housing portion 3 made of biodegradable polylactide is discarded on soil, it is decomposed by soil microorganisms and thereby lends itself to the purpose of decreasing the quantity of waste to be disposed of.

Anything will do as a small article 4, so long as it is suitable in size for being accommodated in the housing portion 3. It will be understood that a piece of chocolate, coffee beans, a sample of a cosmetic or a drug, a storage medium such as a compact disk or a floppy disk, an electronic part such as a chip, a miniature toy, a photograph or a brochure in reduced size, sand or small stones gathered at a tourist resort, or seeds of a flowering plant are merely representative of any of a large number of small articles 4 which can be accommodated in the housing portion 3.

When the article 4 is fairly smaller than the plane area of the cavity 21, the inner surface of the first half 11 can be seen through the transparent housing portion 3. Therefore, an ornamental design 17 is printed on an area of the inner surface of the first half 11 corresponding to the area enclosed with the edge of the opening 15. A printing 18 (in the form of a picture and/or an ad-copy) appears on the marginal area of the reverse of the post card 1 as shown in FIG. 1(*c*), this reverse being constituted by one of the two surfaces of the second half 12 when the sheet 2 has been folded along the center line a. It goes without saying that the ornamental design 17 and the printing 18 must be in harmony with each other.

When the first half 11 has been folded as indicated by an arrow c in FIG. 1(*b*) so as to be in juxtaposition to the second half 12, the folded sheet 2 is squeezed so that the inner surface of the first half 11 may conform closely to the inner surface of the second half 12 as shown in FIGS. 1(*c*) and 2.

The mailing of the post card 1 shown in FIG. 1(*c*) can be rendered inexpensive in cost such that, according to the Japanese postal regulations, an 80-yen stamp has to be affixed if this post card measures 14 to 23.5 cm long by 8 to 12 cm broad, if the overall thickness h of the folded sheet 2 and the housing portion 3 does not exceed 1 cm, and if the gross weight does not exceed 25 g. A 90-yen stamp has to be affixed if the gross weight does not exceed 50 g.

The post card 1 in an assembled condition as shown in FIG. 1(*c*) can be sold in the same manner as is the case with picture postcards. The purchaser has only to write an address, affix a postage stamp, and drop the post card into a mailbox. The recipient of this post card is immediately made aware of the small article 4 through the transparent housing portion 3. The addresser may as well expect the greatest advertising effect from the printing 18 appearing on the reverse of the post card 1 and the ornamental design 17 which can be seen through the housing portion 3, because they will attract the recipient's attention, take him or her by surprise, and furnish a new topic of conversation without fail. If this post card is sent out as direct mail, it will enjoy a much more effective appeal to the recipient than prior art direct mail which is apt to be left unread or even unsealed.

For those who wish to accommodate a small article 4 of their own choosing, the sheet 2 and the housing portion 3 shown in FIG. 1(*a*) may be sold as a kit. In this case, a slip sheet is applied to the adhesive 16 in order to isolate the first half 11 from the adhesive 16. The slip sheet is stripped from the second half 12 by the purchaser, who then accommodates a small article 4 in the housing portion 3 and assembles the post card 1 in order of FIGS. 1(*a*), 1(*b*) and 1(*c*).

Figure 3C:
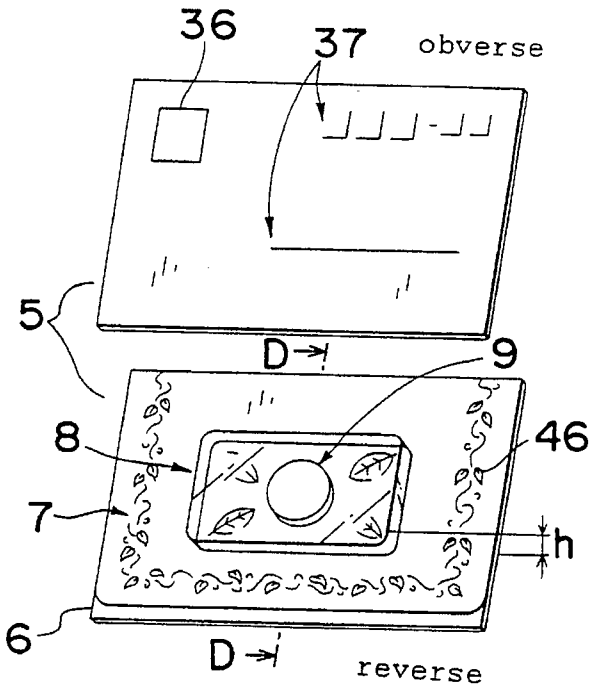
FIGS. 3(*a*)–3(*c*) are perspective views of an embodiment of the present invention for use in the form of a sealed letter.
Figure 3B:
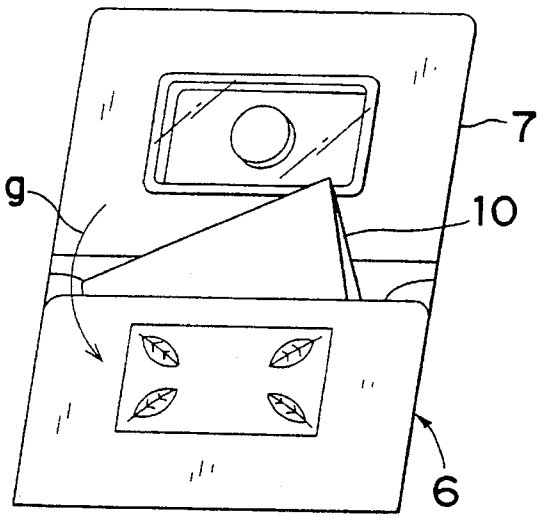
Figure 3A:
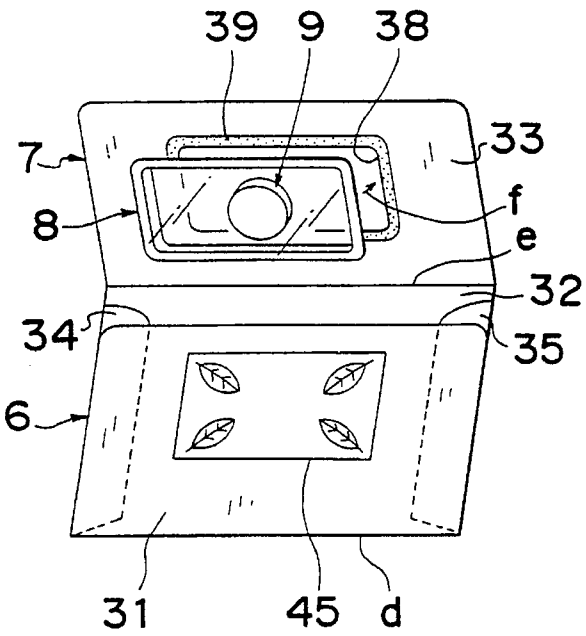

Reference will now be specifically made to FIG. 3 which illustrates an embodiment of the present invention for use in the form of a sealed letter. FIGS. 3(*a*) and 3(*b*) show the procedures for assembling the same, while FIG. 3(*c*) shows a finished letter ready for being mailed.

For those who wish to accommodate a small article of their own choosing, the postal matter in this form may be sold as a kit which consists of an envelope having a flap, a housing portion and letter paper in a knocked-down condition. Alternatively, the postal matter in this form may be sold in an assembled condition with a small article already accommodated in the housing portion. In the latter case, the postal matter in this form is ready for being mailed. The purchaser has only to put letter paper in the envelope, write an address and affix a postage stamp. It is contemplated that the postal matter in this form will be found especially effective when distributed for the purpose of promoting the sale of a small article.

Reference will first be specifically made to the postal matter in this form in an assembled condition. Postal matter for use in the form of a sealed letter 5 in an assembled condition shown in FIG. 3(*c*) comprises an envelope 6 having a flap 7, a housing portion 8 and a small article 9. If circumstances require, letter paper 10 may be attached to the letter 5.

The envelope 6 having a flap 7 in FIG. 3(*a*) is formed from a blank in which two creases d and e are created in a desired dimensionally spaced relationship in such a manner that the blank is parceled out into three portions. A first portion 31 is located at one side of a second portion 32, while a third portion 33 is located at the other side of the second portion 32. The second portion 32 is provided with fins 34 and 35 along another pair of opposite sides thereof. The fins 34 and 35 are folded in such a manner that they ride along the inwardly presented face of the second portion 32. In order to form the envelope 6 as shown in FIG. 3(*c*), the first section 31 is pasted on, or otherwise fastened to, the fins 34 and 35. The front of the envelope 6 thus formed has a portion 36 allotted for affixing a postage stamp and another portion 37 allotted for writing an address thereon. A space for accommodating letter paper 10 is defined by the front and the back of the envelope 6. The postal matter in this form is ready for being mailed when letter paper 10 has been put in the envelope 6 as shown in FIG. 3(*b*) and when the flap 7 has been pasted on, or otherwise fastened to, the back of the envelope 6. The portions 36 and 37 correspond substantially to those shown in FIG. 1.

In this embodiment, the flap 7 is large enough to cover the greater part of the back of the envelope 6 and to have an opening 38, shown in FIG. 3(*a*), in the center thereof. An adhesive 39 such as paste or a pressure sensitive adhesive double coated tape is applied around the opening 38.

Figure 4:
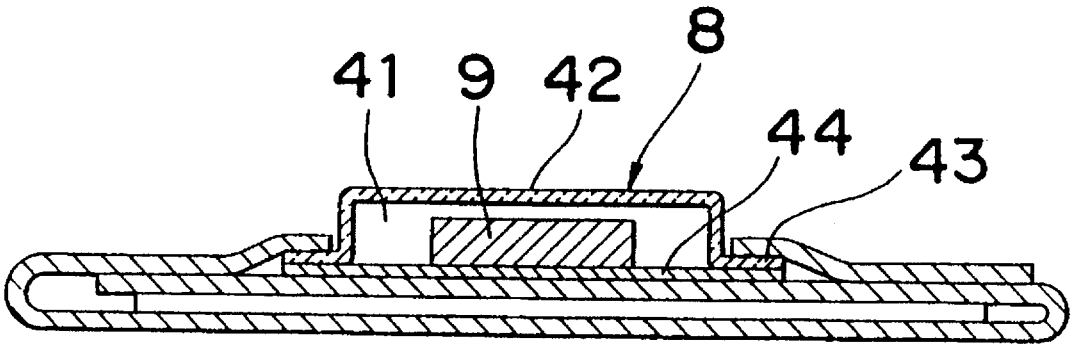
FIG. 4 is a sectional view corresponding to the line D—D of FIG. 3(*c*)
Figure 5A:
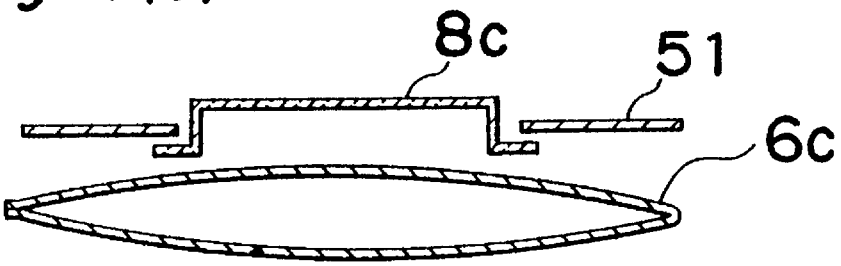
FIGS. 5(*a*)–5(*d*) are sectional views of another embodiment of the present invention for use in the form of a sealed letter.
Figure 5B:
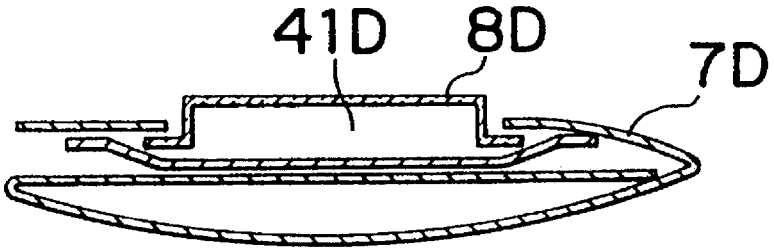
Figure 5C:
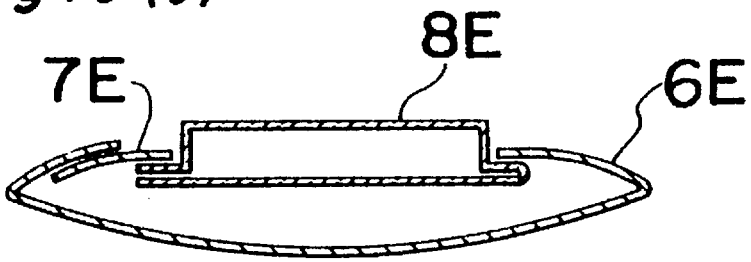
Figure 5D:
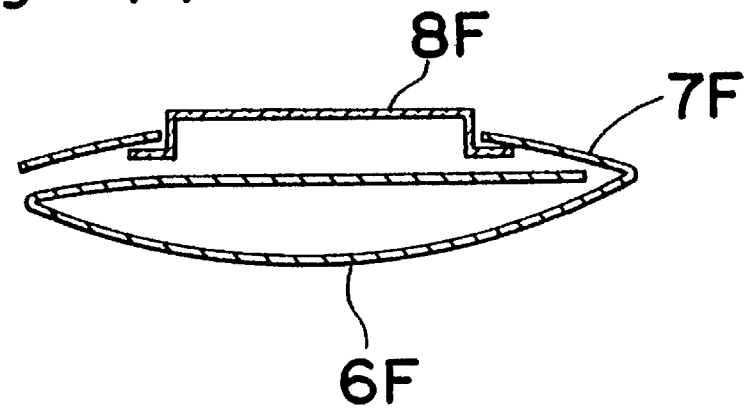
Figure 6D:
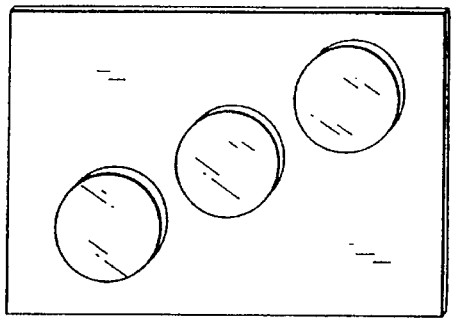
FIGS. 6(*a*)–6(*h*) show various forms of the housing portion.
Figure 6C:
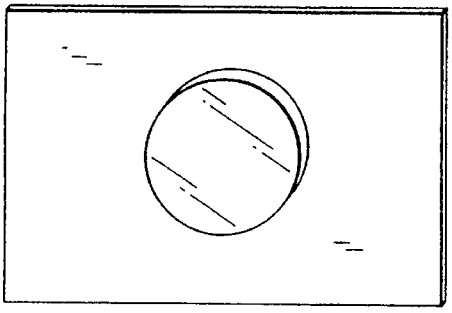
Figure 6B:
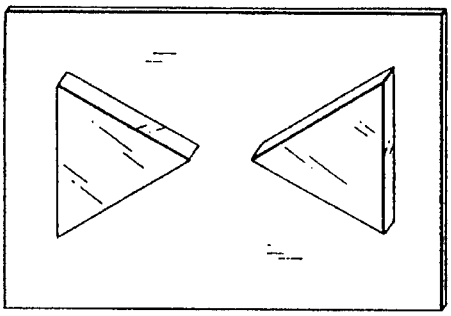
Figure 6A:
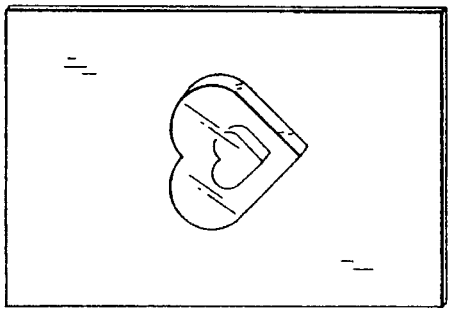
Figure 8H:
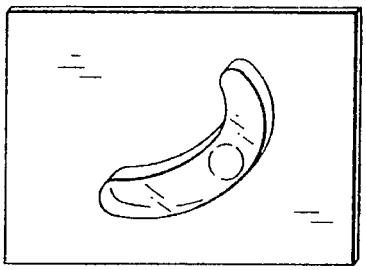
Figure 8G:
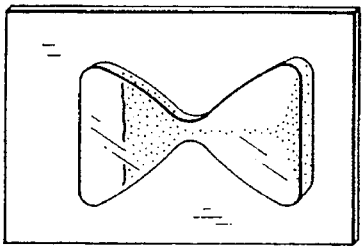
Figure 6F:
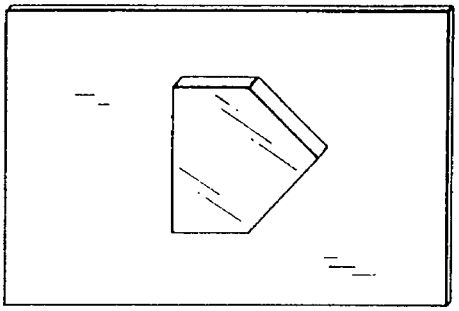
Figure 6E:
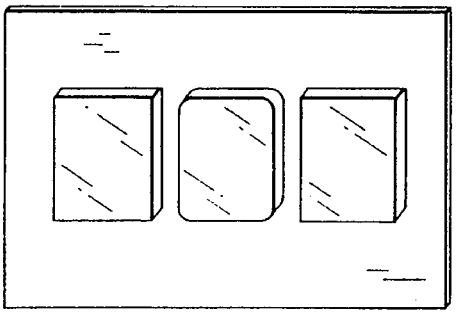

As shown in FIG. 4, the housing portion 8 comprises a central cup section 42 having a cavity 41, a flange 43, and a base member 44. When a small article 9 has been accommodated in the housing portion 8, the base member 44 is bonded with the flange 43 by thermocompression by way of example. With such an arrangement, it is impossible for the small article 9 to fall from the housing portion 8 at the time of inserting letter paper 10 into, or taking it out from, the envelope 6. In so far as the housing portion 8 is made of rigid and transparent material, it is similar to that described above with reference to FIG. 1.

The central cup section of the housing portion 8 is allowed to fit into the opening 38 as indicated by an arrow f in FIG. 3(*a*) to the extent of projecting outwardly of the opening 38. Then, by means of the adhesive 39, the flange 43 is secured to the flap 7 which is constituted by the third portion 33. An ornamental design 45 is printed on an area of the back of the envelope 6 corresponding to the area enclosed with the edge of the opening 38. As shown in FIG. 5(*c*), another ornamental design 46 is printed on the outer surface of the flap 7. It goes without saying that the ornamental designs 45 and 46 must be in harmony with each other.

A person who has purchased the knocked-down or assembled parts intended for a sealed letter 5 prints or writes a message on the letter paper 10, puts it in the envelope 6, folds the flap 7 as indicated by an arrow g so as to allow the flap 7 to be disposed in overlying relationship with respect to the back of the envelope 6, and pastes the flap 7 on, or otherwise fastens it to, the back of the envelope 6. The sealed letter 5 is ready to be dropped into a mailbox when a postage stamp has been affixed to the portion 36 shown in FIG. 3(*c*) and when an address has been written on the portion 37.

The mailing of postal matter in the form of this sealed letter can be rendered relatively inexpensive in cost if the envelope 6 has a prescribed size and if the overall thickness k of the letter paper 10, envelope 6, flap 7 and housing portion 8 falls within a prescribed limit as before described with reference to FIG. 1.

The small article 9, together with the ornamental designs 45 and 46, will attract a recipient's attention to such an extent that he or she cannot help unsealing the sealed letter. If this sealed letter is used as direct mail, a sharp increase in the number of families who unseal direct mail will be hoped for.

When the envelope 6 having a flap 7, the housing portion 8 and the letter paper 10 are to be sold as a kit of knocked-down parts for those who wish to accommodate a small article of their own choosing, it is desirable that the housing portion 8 can be secured either to the envelope 6 or to the flap 7 after the accommodation of the small article in the housing portion 8. Such a desirable construction is shown in FIGS. 5(*a*)–5(*f*). A housing portion 8C shown in FIG. 5(*a*) is directly secured to the back of an envelope 6C by means of a sheet 51 having an opening. The central cup section of a housing portion 8D shown in FIG. 5(*b*) is allowed to fit into an opening provided in a flap 7D. This sealed letter is provided with a sheet 52 adapted to mask a cavity 41D. In case of the sealed letter shown in FIG. 5(*c*), the opening is provided in the back of an envelope 6E having a short flap 7E. A housing portion 8E provided with a base member is secured to the envelope 6E. The central cup section of a housing portion 8F shown in FIG. 5(*d*) is allowed to fit into an opening provided in a flap 7F. The housing portion 8F is provided with a flange which is adapted to be clamped between the flap 7F and the back of an envelope 6F.

Reference will now be specifically made to FIG. 6 which illustrates various forms of the housing portion. A heart-shaped piece of chocolate is accommodated in the heart-shaped housing portion shown in FIG. 6(*a*). This housing portion is suitable for use in sending a gift on St. Valentine's Day. The cup sections of the housing portions shown in FIGS. 6(*b*) to 6(*g*) take the forms of two triangles, one circle, three circles, three rectangles, one pentagon and a sandglass respectively. The cup section of the housing portion shown in FIG. 6(*h*) constitutes the path of movement of a ball.

What is claimed is:

1. Postal matter for use in a form of a sealed letter comprising:

a blank parceled out into three portions, a first portion being located at one side of a first pair of opposite sides of a second portion, a third portion being located at the other side of said first pair of opposite sides of said second portion;

fins provided respectively along another pair of opposite sides of said second portion and folded so as to allow said fins to ride along an inwardly presented face of said second portion;

an envelope formed by folding said first portion so as to allow said first portion to ride along said inwardly presented face of said second portion and by fastening said first portion to said fins;

an opening provided in said third portion which constitutes a flap adapted to close an opening of said envelope;

a housing portion provided with a cup section and a flange, said cup section having a cavity and projecting outwardly of said opening, said flange being secured to said third portion; and a small article accommodated in said housing portion;

said second portion having an outwardly presented face provided with a portion allotted either for affixing a postage stamp thereto or for affixing a postmark indicating that said sealed letter is mailed on terms of separate payment of postage instead of an affixed postage stamp and another portion allotted for indicating an address.

2. Postal matter as defined in claim 1, wherein said envelope has a size and said envelope with its contents and said housing portion have an overall thickness such that said size and said overall thickness fall within limits of rendering said postal matter mailable at a prescribed postal charge.

3. Postal matter as defined in claim 1, wherein said housing portion is made of transparent material so as to allow said small article to be seen therethrough.

4. Postal matter as defined in claim 3, wherein said housing portion further includes a base member.

5. Postal matter as defined in claim 1, wherein said housing portion is made of transparent material so as to allow said small article and a printing to be seen therethrough, said printing appearing on an area of said first portion corresponding to an area enclosed with said opening provided in said third portion.

6. Postal matter as defined in claim 5, wherein another printing appears on a surface of said third portion which constitutes said flap.

7. A postal package kit having component parts capable of being assembled for providing a custom postal package, the kit comprising the combination of an envelope and a housing capable of being secured to said envelope and capable of holding an article therein;

the envelope comprising a blank parceled out into three portions, a first portion being located at one side of a first pair of opposite sides of a second portion, a third portion being located at the other side of said first pair of opposite sides of said second portion, fins provided respectively along another pair of opposite sides of said second portion and folded so as to allow said fins to reside along an inwardly presented face of said second portion, and an opening provided in said third portion which constitutes a flap adapted to close an opening of said envelope;

said envelope being formed by folding said first portion so as to allow said first portion to ride along said inwardly presented face of said second portion and by fastening said first portion to said fins; and said housing portion being provided with a cup section and a flange, said cup section having a cavity and projecting outwardly of said opening, said flange being capable of being secured to said third portion of said envelope.

8. Postal matter as defined in claim 7, wherein said envelope has a size and said envelope with its contents and said housing portion have an overall thickness such that said size and said overall thickness fall within limits of rendering said postal matter mailable at a prescribed postal charge.

9. Postal matter as defined in claim 7, wherein said housing portion is made of transparent material.

10. Postal matter as defined in claim 9, wherein said housing portion further includes a base member.

11. Postal matter as defined in claim 7, wherein said housing portion is made of transparent material and said envelope has printing appearing on an area of said first portion corresponding to an area enclosed with said opening provided in said third portion.

12. Postal matter as defined in claim 11, wherein another printing appears on a surface of said third portion which constitutes said flap.

13. Postal matter for use in a form of a sealed letter comprising:

a blank parceled out into three portions, a first portion being located at one side of a first pair of opposite sides of a second portion, a third portion being located at the other side of said first pair of opposite sides of said second portion;

fins provided respectively along another pair of opposite sides of said second portion and folded so as to allow said fins to ride along and inwardly presented face of said second portion;

an envelope being formed by folding said first portion so as to allow said first portion to ride along said inwardly presented face of said second portion and by fastening said first portion to said fins;

an opening being provided in said third portion which constitutes a flap adapted to close an opening of said envelope;

a housing portion provided with a cup section and a flange, said cup section having a cavity and projecting outwardly of said opening, said flange being secured to said third portion.

14. Postal matter as defined in claim 13, wherein said envelope has a size and said envelope with its contents and said housing portion have an overall thickness such that said size and said overall thickness fall within limits of rendering said postal matter mailable at a prescribed postal charge.

15. Postal matter as defined in claim 13, wherein said housing portion is made of transparent material.

16. Postal matter as defined in claim 13, wherein said housing portion further includes a base member.

17. Postal matter as defined in claim 16, wherein another printing appears on a surface of said third portion which constitutes said flap.

18. Postal matter as defined in claim 13, wherein said housing portion is made of transparent material so as to allow a printing to be seen therethrough, said printing appearing on an area of said first portion corresponding to an area enclosed with said opening provided in said third portion.

* * * * *